US010549208B1

(12) United States Patent
Herren

(10) Patent No.: US 10,549,208 B1
(45) Date of Patent: Feb. 4, 2020

(54) PORTABLE BALLOON TYING DEVICE

(71) Applicant: Gerald R. Herren, Cookeville, TN (US)

(72) Inventor: Gerald R. Herren, Cookeville, TN (US)

( * ) Notice: Subject to any disclaimer, the term of this patent is extended or adjusted under 35 U.S.C. 154(b) by 0 days.

(21) Appl. No.: 15/694,655

(22) Filed: Sep. 1, 2017

(51) Int. Cl.
*A63H 27/10* (2006.01)

(52) U.S. Cl.
CPC ..... *A63H 27/10* (2013.01); *A63H 2027/105* (2013.01)

(58) Field of Classification Search
CPC ..... A63H 27/10; A63H 27/1008; A63H 2027/105; A63H 2027/1008–1091; D03J 3/00; A01K 91/04
USPC ..... D8/40, 356; D21/453, 84
See application file for complete search history.

(56) References Cited

U.S. PATENT DOCUMENTS

| | | | | | |
|---|---|---|---|---|---|
| 888,580 | A | | 5/1908 | Brinn | |
| 1,008,190 | A | | 11/1911 | O'Connell | |
| 1,731,574 | A | | 10/1929 | House | |
| 2,810,379 | A | * | 10/1957 | Solomon | A63H 37/00 124/16 |
| 2,825,592 | A | * | 3/1958 | Semple | A01K 91/04 289/17 |
| 3,177,021 | A | | 4/1965 | Benham | |
| 3,572,788 | A | | 3/1971 | Cruzan | |
| 3,837,691 | A | | 9/1974 | Smythe | |
| 4,029,346 | A | | 6/1977 | Browning | |
| 4,864,762 | A | | 9/1989 | Cox | |
| 4,989,906 | A | | 2/1991 | Peverley | |
| 5,021,022 | A | * | 6/1991 | Ganz | A63H 27/10 446/220 |
| 5,039,142 | A | | 8/1991 | Muma | |
| 5,098,137 | A | * | 3/1992 | Wardall | A01K 91/04 289/17 |
| 5,314,217 | A | | 5/1994 | Place | |
| 5,568,950 | A | | 10/1996 | Herren | |
| 5,611,578 | A | * | 3/1997 | Angelico, Sr. | A63H 27/10 289/17 |
| 5,820,169 | A | | 10/1998 | Butler et al. | |
| 6,273,479 | B1 | | 8/2001 | Carlson | |
| 6,902,212 | B1 | | 6/2005 | Mize | |
| 7,967,344 | B2 | | 6/2011 | Herren | |
| 8,292,335 | B1 | * | 10/2012 | Hemingway | A63H 27/10 289/17 |
| 2011/0253255 | A1 | * | 10/2011 | Dellaquila | A63H 27/10 141/98 |
| 2012/0130416 | A1 | * | 5/2012 | Okos | A61M 29/00 606/194 |
| 2016/0325150 | A1 | * | 11/2016 | Johnson | A63H 27/10 |

FOREIGN PATENT DOCUMENTS

| | | | |
|---|---|---|---|
| GB | 1321066 | A * | 6/1973 |

* cited by examiner

*Primary Examiner* — Ismael Izaguirre
(74) *Attorney, Agent, or Firm* — Baker Donelson; Carl M Davis, II; Dorian B Kennedy

(57) ABSTRACT

A balloon tying device has a base and a cantilever supported by the base. The cantilever has a U-shaped cross-section and two ears defining generally parallel planes extending outwardly and terminating at a tip for retaining a loop of balloon material. Inside the U-shape of the cantilever is an axially oriented recess for passing ribbon and providing clearance for tucking an overhand knot in a balloon tail. A brace tab extends downward from the lower edge of the base.

29 Claims, 5 Drawing Sheets

PORTABLE BALLOON TYING DEVICE

TECHNICAL FIELD

This invention relates to devices that aid in tying knots and more particularly to portable devices with support structures to aid in hand-tying half-hitch knots, especially in balloons and the like. Spooled and pre-cut ribbon can be tied integral with the knot.

BACKGROUND OF INVENTION

Balloons with ribbons and the like are generally tied with a half-hitch knot. First, a loop is made in the balloon tail, passing the end over the standing part, then passing the end under the standing part and through the loop. See The World Book Dictionary, Clarence L. Barnhart and Robert K. Barnhart, editors, World Book, Inc., publisher, 1990, page 956, column 3. The loop is usually made around one or more fingers, which has disadvantages, among which are: 1. Difficulty of passing the end through the loop, because the material is generally kept very tight to prevent air or gas from escaping from the balloon; 2. Damage to the material while tying the knot therein; 3. Fatigue of the hands, especially the fingers, due to tying many balloons; 4. Extra time is often required to avoid or cope with the above listed disadvantages.

There are various commercially available devices which can be attached to the open ends of balloons to seal the air or gas there inside. Such products do not relate to the invention because when such devices are removed from the balloon, the air or gas escapes therefrom.

Other devices, such as that disclosed by Peverley in U.S. Pat. No. 4,989,906, issued on Feb. 5, 1991, attach to fixed support means via a bracket. Such devices are not generally portable since they must be secured to a fixed support. There is a need for a balloon tying device which can be held in the hand or positioned on a stanchion while operated with both hands to facilitate easy tying of balloons.

U.S. Pat. No. 7,967,344 shows a portable balloon tying device. While this device provided a great leap in the ability to tie a balloon, improvements to this type of device could improve the ability to quickly and efficiently tie balloons so that the balloon did not fall off the end of the device during the tying process. Conversely, an improvement could enable an overly stretched balloon to more easily be removed from the device.

Accordingly, there is a need in the art for an improved device for tying a balloon while providing for optimal ease in separating the balloon from the device. It is to such that the present invention is directed.

SUMMARY OF THE INVENTION

The present invention meets the need in the art by providing a portable balloon tying device comprising a base configured to receive a support structure, said base is a vertically extending tube, and wherein said base includes a ribbon slot extending through said tube and an elongated cantilever extending outwardly from the base. The cantilever has an exterior surface with at least one outwardly longitudinally extending ridge, whereby a ribbon extends through the ribbon slot and along the cantilever for being tied to a neck of an inflated balloon during knotting.

In another aspect, the present invention provides a portable balloon tying device comprises a tubular base with a channel there through to receive a support structure and an elongated cantilever having a U-shaped cross section extending outwardly from the base having at least one elongated shoulder extending outwardly from the tubular base closely adjacent the junction point between the tubular base and the elongated cantilever, and said cantilever has an exterior surface with three outwardly, longitudinally extending ridges.

In another aspect, the present invention provides a portable balloon tying device comprises a tubular base configured to receive a support structure. The tubular base has an exterior surface, an interior surface opposite the exterior surface, a top portion and a bottom portion opposite the top portion. The device also has an elongated cantilever extending outwardly from the base with a U-shaped cross section. The device also has a ribbon slot extending through the tubular base within the confines of the U-shaped cross section of the cantilever. The ribbon slot has a floor sloped upwardly towards the top portion as it extends from the exterior surface towards the interior surface.

In another aspect, the present invention provides a portable balloon tying device comprises a tubular base configured to receive a support structure. The tubular base has an exterior surface, an interior surface opposite said exterior surface, a top portion, and a bottom portion opposite the top portion. A brace tab extends from the bottom portion and terminates at a distal edge with a flange extending laterally therefrom. The flange has an arcuate surface for stabilized resting of the balloon tying device on a portion of a support structure during use. An elongated cantilever extends outwardly from the base with a U-shaped cross-section, for with opposing walls for receiving a ribbon between a pair of opposing wall of the cantilever for securing to a balloon. A flange extends from an inner surface of the U-shaped cross-section of the cantilever between the opposing walls with a gap between an opposing portion of the inner surface and a distal end of the flange for receiving a portion of the ribbon therethrough.

In another aspect, the present invention provides a portable balloon tying device comprises a tubular base configured to receive a support structure. The tubular base has an exterior surface, an interior surface opposite the exterior surface, a top portion, and a bottom portion opposite the top portion. A brace tab extends from the bottom portion and terminates at a distal edge for stabilized resting on a portion of a support structure during use of the balloon tying device. The brace tab has a bevel on a surface proximate the base on a portion proximate a side edge and the distal end of the brace tab, for bearing contact with a portion of the support structure during use of the balloon tying device. An elongated cantilever extends outwardly from the base with a U-shaped cross-section, for receiving therein a ribbon for securing to a balloon.

In another aspect, the present invention provides a portable balloon tying device comprising a tubular base configured to receive a support structure, said tubular base having an exterior surface, an interior surface opposite said exterior surface, a top portion, and a bottom portion opposite said top portion. An elongated cantilever extending outwardly from said base, said cantilever having a U-shaped cross-section, and a distal end having a first slot and a second slot, the first slot defined by a cross bridge extending between opposing sides of the cantilever and spaced above a floor of the cantilever for receiving therethrough at least one ribbon for securing to a balloon, the second slot defined by a cantilever flange extending from one of the opposing sides of the elongated cantilever and vertically spaced from the cross bridge and a gap between a distal end of the cantilever flange and the other of the opposing sides of the elongated cantilever for receiving a ribbon through the gap into the second slot for securing to a balloon and readily released from the gap thereafter.

In another aspect, the present invention provides a portable balloon tying device comprising a tubular base with a channel there through to receive a support structure and said base includes a ribbon slot extending through a wall thereof; and an elongated cantilever extending outwardly from said base, at least one planar surface portion extending outwardly from said tubular base closely adjacent the junction point between said tubular base and said elongated cantilever, whereby a ribbon extending through the ribbon slot and along the cantilever for being tied to a neck of an inflated balloon during knotting while the neck is pressed against the planar surface portion.

In another aspect, the present invention provides a portable balloon tying device comprising a tubular base with a channel there through to receive a support structure; and an elongated cantilever extending outwardly from said base, at least one planar surface portion extending outwardly from said tubular base closely adjacent the junction point between said tubular base and said elongated cantilever, said cantilever includes two oppositely disposed sidewalls, each sidewall having a top edge, a retaining edge extending generally normally from said top edge, and a bottom edge extending generally normally from said retaining edge.

Beneficial advantages and features of the present invention may readily be ascertained upon a reading of the following detailed description in conjunction with the drawings and the appended claims.

DETAILED DESCRIPTION

Figure 1:
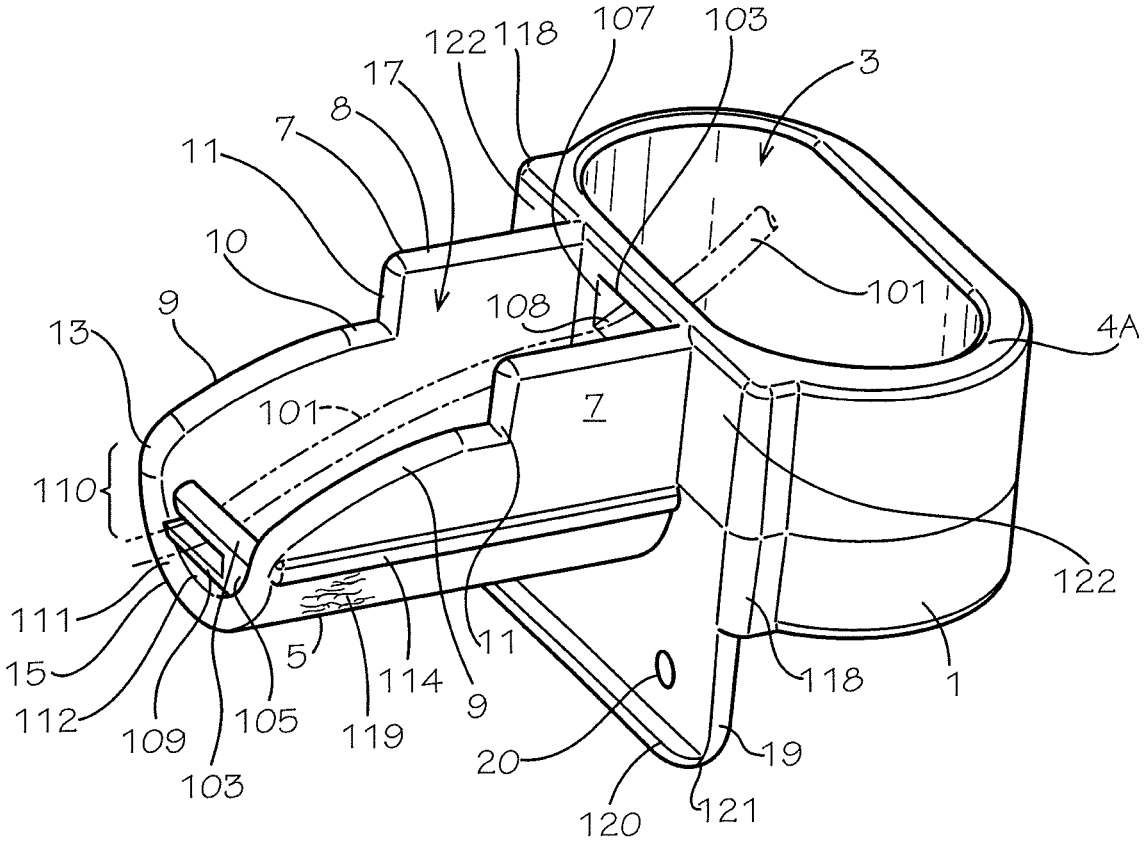
FIG. 1 illustrates in perspective view a balloon tying device having structural features in illustrative embodiments according to the present invention.
Figure 2:
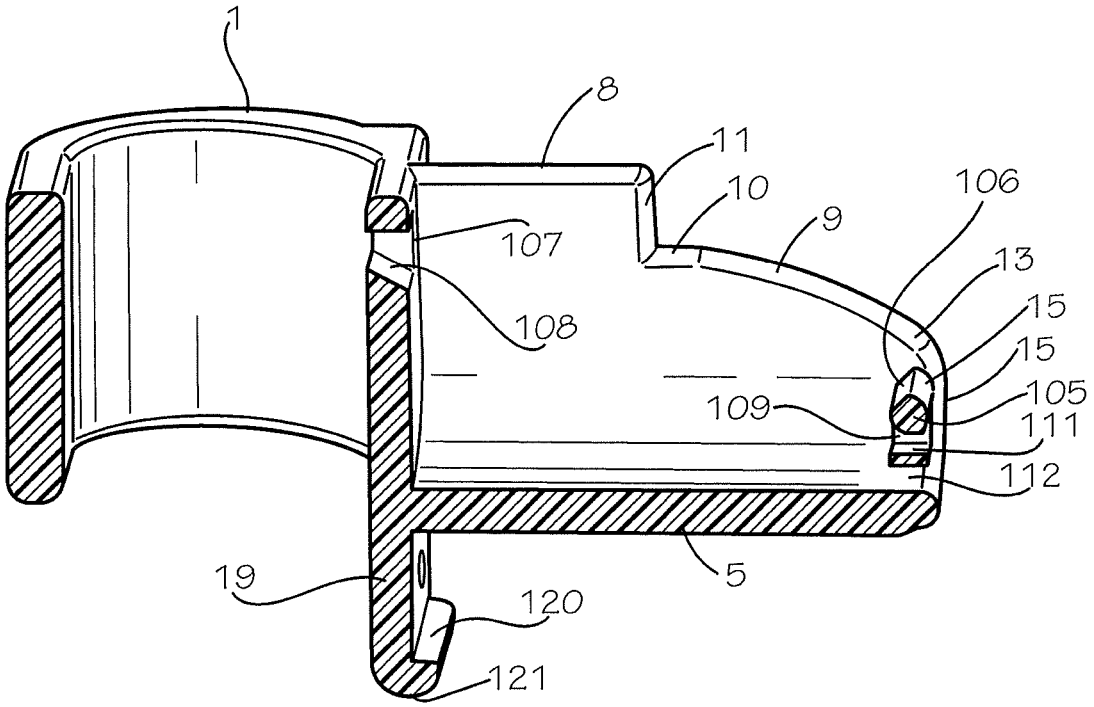
FIG. 2 illustrates in cross-sectional view the balloon tying device of FIG. 1.

With reference to the drawings in which like parts have like reference numerals, there is shown a portable balloon tying device in a preferred form of the invention. The device includes an generally oblong shaped tubular base 1 which supports a U-shaped balloon mounting flange or cantilever 5. The U-shaped cantilever has opposing side walls and a curved bottom. The base 1 is hollow having a generally oblong shaped opening 3 to assist in mounting to a support structure, such an operator's fingers, preferably first and second fingers, or a stanchion in a tying station, a tank stand, a caddy leg, or a waist belt device. It should be noted that the wall of the base 1 is thicker on one end 4*a* so as to make the opening 3 somewhat asymmetrical to conform better to human fingers. During use of the device, the end wall 4*a* of the base 1 that is thicker is inwardly lateral of an outer side (or thumb-side) of the operator's hand and thus, interior of the hand for disposing the end wall portion 4*a* between adjacent fingers.

Proximal to the base 1, each side wall of the cantilever 5 has an ear 7 having a generally horizontally extending top edge 8 which terminates at a vertically extending retaining edge 11. The two ears 7 are generally parallel due to the U-shape of the cantilever 5.

A generally horizontal bottom edge or plateau 10 extends from the retaining edge 11. The purpose of the plateau 10 is to keep the balloon tying operation sufficiently above the supporting hand to allow sufficient clearance for manipulation of portions of the balloon with the cantilever 5 with the other hand during balloon-tying operations. An arcuate or curved holding edge 9 extends directly from the bottom edge 10 to an end 15 of the cantilever 5. Near the end 15, the holding edge 9 preferably has an increasing radius 13 for ensuring that the balloon is not damaged upon removal from the device. The purpose of the holding edges 9 is to provide an opening there between to allow sufficient clearance for manipulation of the balloon through the opening with the other hand. The arcuate or curved shape of the holding edge 9 also facilitates the removal of a tied balloon by reducing the circumference of the stretched portion of the balloon about the cantilever 5 and therefore promoting the rolling-off of the tied balloon from the cantilever.

An axially oriented trough or recess 17 extends from the base 1 and between the ears 7 and holding edges 9 to the end 15 for establishing a space or opening through which a thumb and a finger of the other hand of a balloon-tying operator can push and pull the end of a balloon in order to complete a knot. The recess 17 should therefore be at least ⅝ inch wide, and preferably ¾ inch wide to fit most normal sized human fingers.

Spooled ribbon or pre-cut ribbon 101 may be routed through the axially oriented recess 17 and positioned to rest in the center opening thereof such that when the knot is cinched, the ribbon passes through the core of the knot thereby making the ribbon integral with or secured by the knot. This enables construction of a balloon arch on a continuous ribbon and also allows one or more individual ribbons to be attached for each balloon. The invention can integrate either a single ribbon or multiple ribbons of the same color or different colors in the balloon knot.

A proximal ribbon retainer 103 in the form of a ribbon retainer slot 107 extends through the base 1 between the ears 7. The ribbon retainer slot 107 includes an inclined floor or surface 108 which rises as the floor 108 extends from proximal the cantilever 5 (exterior surface of the base) to distal the cantilever 5 (interior surface of the base). The inclined surface 108 aids in pushing the ribbon through the slot 107 towards the end 15 of the cantilever for ease in grasping and guiding the ribbon as it passes through the slot 107.

A distal ribbon guide generally 110 is positioned closely adjacent the end 15 of the cantilever 5. The ribbon retainer guide 110 in the illustrated embodiment includes a bridge 111 extending between the interior walls of the cantilever 5 and an adjacent ribbon retainer 105. The bridge 111 is spaced above the curved bottom surface of the cantilever 5 and defines a passage gap 112. The passage gap 112 receives ribbon(s) therethrough as discussed below during balloon tying operations. The bridge 111 and passage gap 112 are positioned such that a ribbon extending longitudinally along the cantilever 5 from the base 1 may remain positioned in the lower quadrant of the axially oriented recess 17 thereby allowing easy access for fingers to the balloon during tying operations. The bridge 111 is gainfully used during balloon arch construction operations as discussed below.

The disclosed device further provides a second ribbon receiving retainer slot with the distal ribbon retainer 105. The distal ribbon retainer 105 is a cantilever flange member attached to a first one of the walls of the cantilever 5 vertically spaced from the bridge 111. The ribbon retainer 105 extends towards the opposing wall to leave a gap between a distal end of the retainer 105. The vertical spacing of the ribbon retainer 105 defines a ribbon receiving slot 109 between the retainer 105 and the bridge 111. The ribbon retaining slot 109 is thereby open at one end to enable a ribbon(s) to be slid laterally into the slot 109, during balloon tying operations as discussed below.

A top surface 106 of the distal ribbon retainer 105 is angled upwardly as it extends from a side portion towards the end 15 to prevent longer fingernails of a balloon-tying operator from contacting or catching on the distal ribbon retainer 105 during use of the device. The proximal ribbon retainer 103 and distal ribbon retainer 105 are positioned such that the ribbon 101 remains positioned in the lower quadrant of the axially oriented recess 17 thereby allowing easy access for fingers to the balloon during tying operations. The ribbon retainer 105 is gainfully used during single balloon tying operations as discussed below.

The bridge 111 and the ribbon retainer 105 are preferably recessed inwardly from the end 15 of the cantilever and recessed below the upper surface of the arcuate holding edge 9, so that the tie portions of the balloon move over without contacting during a tied balloon removal step. The illustrated embodiment according includes both the bridge 111 and its passage gap 112 and the ribbon retainer 105 and its slot 109, for use of the device for single balloon tying operations or selectively for balloon arch construction operations. Alternate embodiments having only one of the ribbon slots may be gainfully employed (a) with the bridge 111 and passage gap 112 configured only for single balloon tying operations or (b) with the ribbon retainer 105 and slot 109 for balloon arch construction operations.

Figure 3:
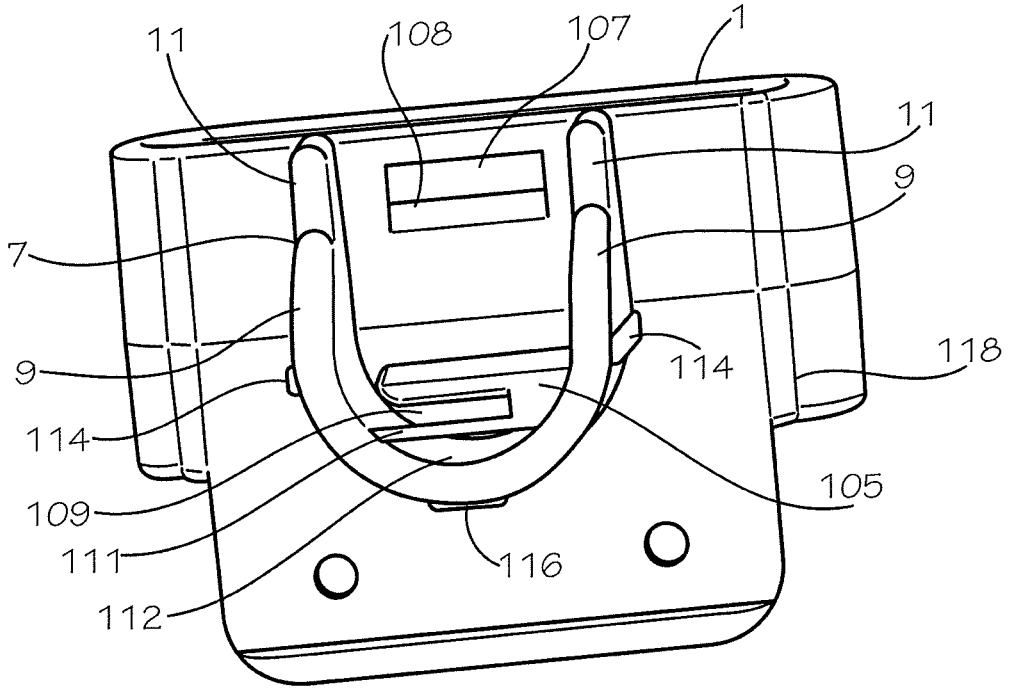
FIG. 3 illustrates in a front, perspective view the balloon tying device of FIG. 1.
Figure 4:
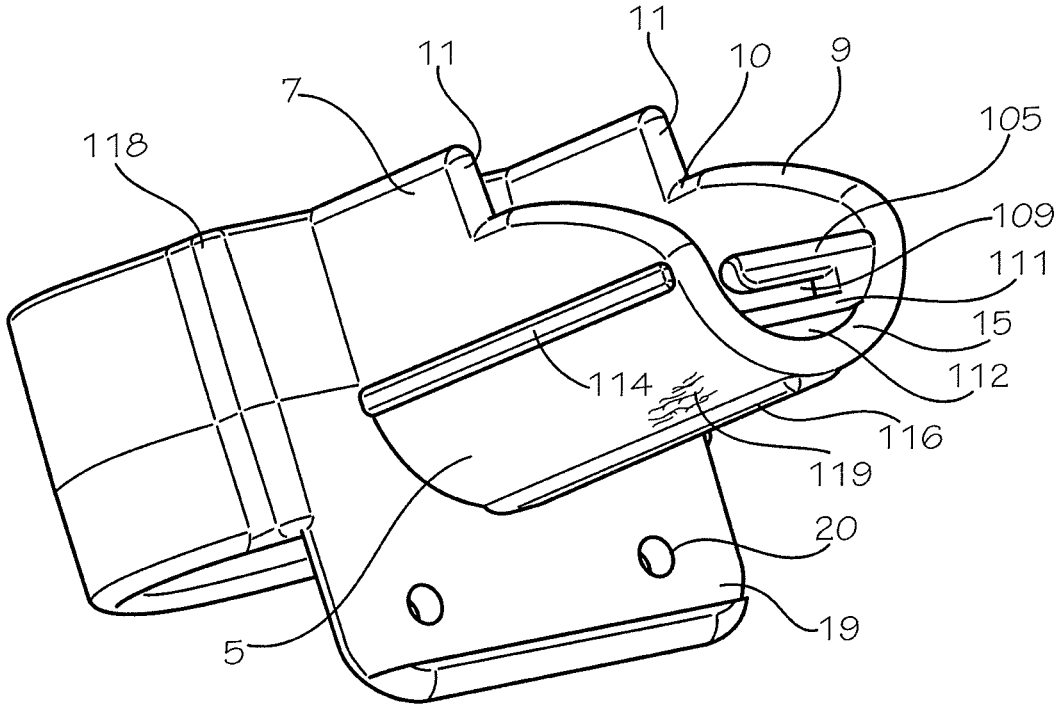
FIG. 4 illustrates in a bottom, perspective view a portion of the balloon tying device of FIG. 1.

The exterior or outer surface of the cantilever 5 includes three longitudinally extending ridges; specifically in the illustrated embodiment, there are two oppositely disposed side ridges 114 and a bottom ridge 116, as best illustrated in FIG. 3. The purpose of the ridges 114 and 116 is to minimize contact of the balloon skin and device surface, and therefore reduce friction, between the wrapped balloon and the cantilever 5. Minimizing friction between the balloon and the cantilever 5 aids in pulling the tied balloon off the cantilever. The exterior surface of at least the cantilever 5 may also be provided with a matte finish 119, for example in the illustrated embodiment, a SPI A-3 finish, to aid in the removal of the balloon. The matte finish aid removal by reducing surface friction between the balloon and the cantilever 5 surface. Further, the matter finish provides a softer feel for placing the device on an operator's hand as well as provide an overall uniform ornamental appearance when formed over the entire surface.

A brace tab 19 extends downward from the base 1 to a distal edge, for resting on a portion of the support structure to stabilize the tying device. The distal edge may define an arcuate face. In the illustrated embodiment, a flange 120 extends laterally from the distal bottom portion of the brace tab 19. The flange 120 extending laterally therefrom has an arcuate surface 121 to provide a wider broader edge than the brace tab 19 without the flange, for more comfortable holding and stabilized resting on a portion of a support structure such as a upper palm portion of an operator's hand during use of the device for balloon tying operations. The arcuate edge 121 assists use processes in that during such the edge more comfortably distributes loading imposed by the balloon tying operations on the palm of the operator. Further, many, if not all, corners and edges of the device are preferably rounded or curled as shown in the drawings to ensure comfort and ease of use. The base tab 19 includes two mounting holes 20 therethrough through which screws may pass to secure the device to a support.

At the junction of the cantilever 5 to the base 1 the base includes two oppositely disposed, vertically extending elongated shoulders or seal offs 118. The shoulders 118 provide a high relief ridge that aids in providing a contact point or ridge for the operator's thumb to press against when sealing the neck of the balloon during the tying process. The shoulders 118 are preferably arcuate. The elongated shoulders 118 are spaced-apart laterally from an exterior surface of a respective one of the ears 7, such that a curved end of the base 1 is lateral of the cantilever 5 by a portion 122 of the brace tab 19 that is co-extensive and defines a planar wall of the base 1. The spaced-apart shoulders 118 and portion 122 facilitates balloon tying operations with thumb bearing surfaces for sealing the balloon from escape of air or gas during balloon tying operations. The thumb of the operator's hand holding the device with fingers through the base 1 may push balloon tail against the shoulder 118 and/or slip into the angled portion of the face portion 122 of the brace tab 19 and the ear 7 while sealing the balloon tail from escape of air or gas during balloon tying operations.

Figure 5:
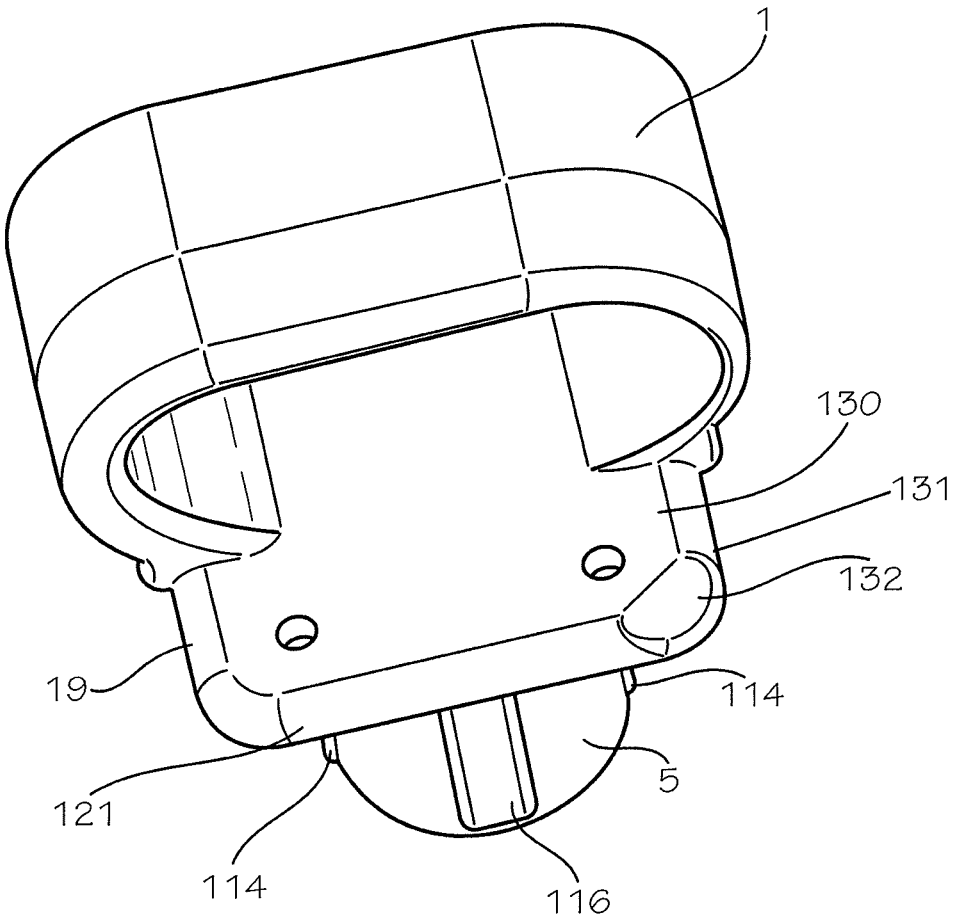
FIG. 5 illustrates in a back, perspective view the balloon tying device of FIG. 1.

FIG. 5 illustrates in a back, perspective view the balloon tying device of FIG. 1 depicting a back 130 of the brace tab 19 proximate the base 1. A corner portion 131 of the back 130 a proximate a side edge and the distal end 121 of the brace tab 19 defines a planar bevel surface 132. The bevel surface 132 during use of the device bears against the palm of the operator's hand intermediate the finger and the thumb. The tapered surface facilitates fit and loading during balloon tying operations of pulling a tail portion of the balloon and making the knot.

The device is preferably constructed of plastic, and is preferably fabricated by injection molding preferably as a unitary body, or alternatively although more expensive, snap assembled of parts although relative parts may flex during balloon tying operations. However, any suitable conventional material can be used, and any suitable conventional fabrication means can be used.

A preferred method of using the device is illustrated in sequential FIGS. 5-8 of U.S. Pat. No. 7,967,344 which is specifically incorporated herein by reference in its entirety. The device is slid over two fingers of one hand 16 (shown in FIGS. 5-8 of U.S. Pat. No. 7,967,344) with the fingers extending through opening 3. For single balloon tying operations, a ribbon 101 is passed through the fingers and held in position, clear of the tying fingers, by ribbon retainer 103 and distal ribbon retainer 105 with the ribbon positioned in ribbon retainer slots 107 and 109. The invention can be used in this manner over any one or more fingers and can also mount on another support structure such as a stanchion in a tying station, a tank stand, a caddy leg, or a waist belt device.

An inflated balloon 20 is then held with the thumb 18 of the one hand 16 bearing the balloon against the shoulder 118 and/or against the wall portion 122, whilst the open end 22 thereof is stretched from outwardly of the hand first across the outwardly proximate plateau 10, across the open cantilever 5, and the opposing plateau 10. The retaining edge 11 and stretching of the balloon holds the balloon in the angled junction of the respective plateau 10 and edge 11. Then the open end 22 is wrapped around the side, bottom, and opposing side of the cantilever 5 until the stretched balloon crosses over itself. As noted above, additionally, a ribbon spool 110 can be positioned or mounted on a base to feed spooled ribbon 101 through the axially oriented recess 17. The thumb pressed against the shoulder 118, and/or on the wall portion 112, provide a good sealing line along the balloon to restrict escape of air or gas during the tying operation.

It should be noted that the 90 degree angle between the bottom edge 10 and the vertical retaining edge 11 provides for a stable platform so that the stretched balloon does not move forward along the cantilever 5 or backwards towards the base 1. (Subsequently after forming the knot, the curvature of the curved holding edge 9 aids in forcing the stretched balloon off the end of the cantilever 5 once the tail of the balloon is pulled outwardly in a direction away from the base 1 from the cantilever 5 along a line substantially coaxial with a longitudinal axis of the cantilever. Pulling the tail pulls the stretched balloon portions along the arcuate edge 9 and past or over the radiused portion 13 of the end 15.)

The knot forming operation continues with the balloon neck or open end then passed over the portion stretched between the ears 7, then downwardly through the recess 17 proximate the base 1, under the portion stretched between the ears 7 and upwardly from the recess 17 proximate the end 15, forming a half-hitch knot 30 around the cantilever 5. The knot 30 is then easily slid distally off the cantilever 5 with the ribbon positioned integral or secured with the knot 30. The knot is rapidly pulled to tightness to complete the half-hitch knot with integral ribbon in the balloon to seal the same and hold compressed air or gas therein. The tail of the balloon is pulled outwardly in a direction away from the base 1 from the cantilever 5 along a line substantially coaxial with a longitudinal axis of the cantilever. Pulling the tail pulls the stretched balloon portions along the arcuate edge 9 and past or over the radiused portion 13 of the end 15. The ribbon slides out of the gap of the flange 105 and the length of ribbon cut selectively. This enables tying individual ribbons for each balloon.

A balloon arch is readily constructed similarly. After receiving the device on the hand with the first two fingers proximate the thumb through the recess 3, a ribbon 101 is passed through the fingers and held in position in the cantilever 5, clear of the tying fingers, by the ribbon retainer 103 with the ribbon positioned in ribbon retainer slot 107 and the distal passageway gap 112.

An inflated balloon 20 is then held with the thumb 18 of the one hand 16 bearing the balloon against the shoulder 118 and/or against the wall portion 122, whilst the open end 22 thereof is stretched from outwardly of the hand first across the outwardly proximate plateau 10, across the open cantilever 5, and the opposing plateau 10. The retaining edge 11 and stretching of the balloon holds the balloon in the angled junction of the respective plateau 10 and edge 11. Then the open end 22 is wrapped around the side, bottom, and opposing side of the cantilever 5 until the stretched balloon crosses over itself. The thumb pressed against the shoulder 118, and/or on the wall portion 112, provides a good sealing line along the balloon to restrict escape of air or gas during the tying operation.

The 90 degree angle between the bottom edge 10 and the vertical retaining edge 11 provides for a stable platform so that the stretched balloon does not move forward along the cantilever 5 or backwards towards the base 1. The knot forming operation continues with the balloon neck or open end then passed over the portion of the balloon stretched between the ears 7, then downwardly through the recess 17 proximate the base 1, and upwardly from the recess proximate the end 15, forming a half-hitch knot 30 around the cantilever 5 and the stretched balloon end. The knot 30 is then easily slid distally off the cantilever 5 with the ribbon positioned integral or secured with the knot 30. The knot 30 is rapidly pulled to tightness to complete the half-hitch knot with integral ribbon secured in the knot of the balloon that seals the balloon and holds the compressed air or gas therein. This is accomplished by pulling the tail of the balloon rapidly and smoothly outwardly in a direction away from the base 1 from the cantilever 5 along a line substantially coaxial with a longitudinal axis of the cantilever. Pulling the tail pulls the stretched balloon portions along the arcuate edge 9 and past or over the radiused portion 13 of the end 15. The ribbon slides out of the gap of the flange 105. A lighter-than-air balloon will then float upwardly pulling the ribbon through the passageway 112. After a selected length, the ribbon is stopped, and the inflated balloon tying operation is performed for a subsequent balloon. This enables tying a balloon archway having a continuous ribbon through multiple balloons or, alternatively, by cutting the ribbon to selected length, having individual ribbons for each balloon.

The device can be used to tie a knot in any material which can be wrapped around the cantilever, passed through the recess 17, and pulled therefrom, and particularly for knotting or tying a balloon, in reference to FIGS. 6A-6H illustrating operation of the balloon tying device of FIG. 1 according to the present invention.

Figure 6B:
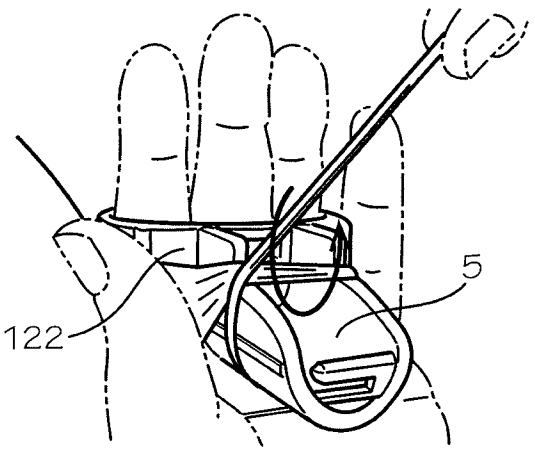
FIG. 6A-6H illustrate operation of the balloon tying device of FIG. 1 according to the present invention.
Figure 6D:
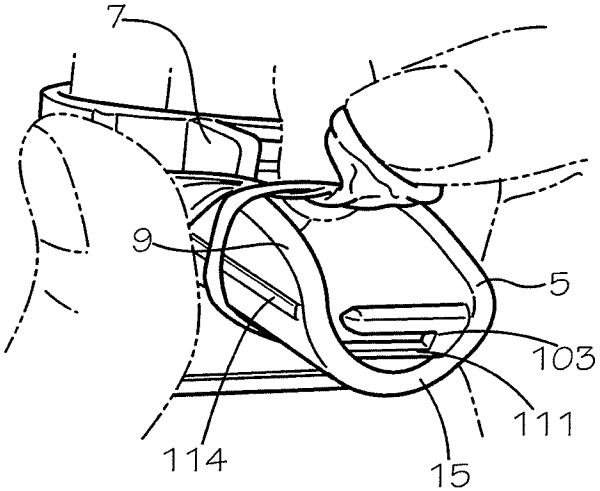
Figure 6A:
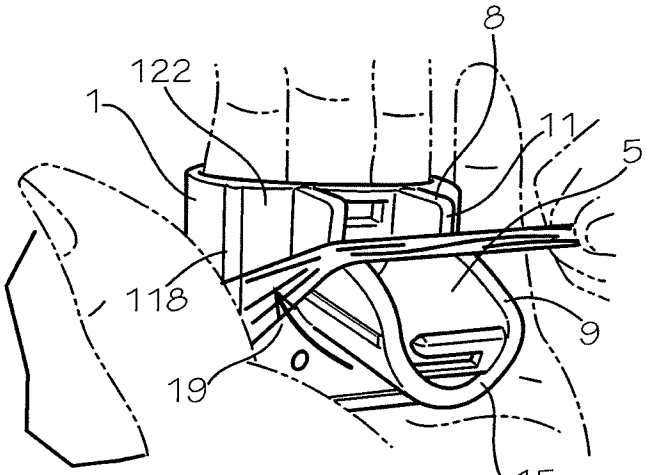
Figure 6C:
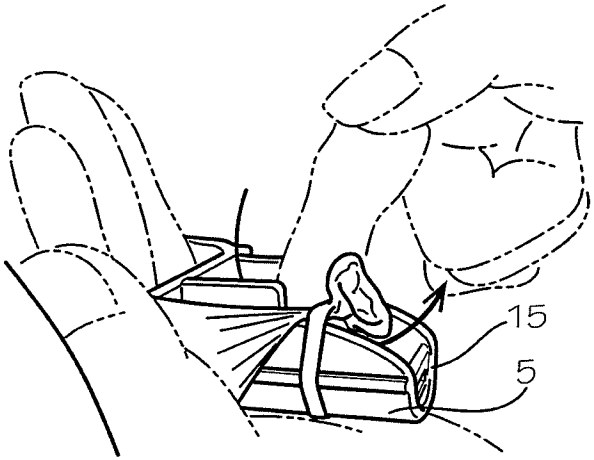
Figure 6F:
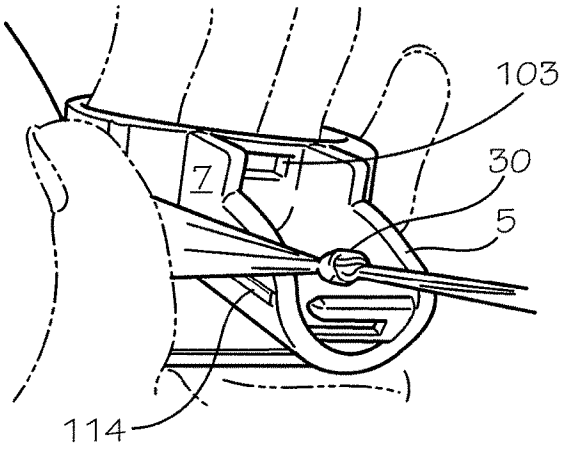
Figure 6H:
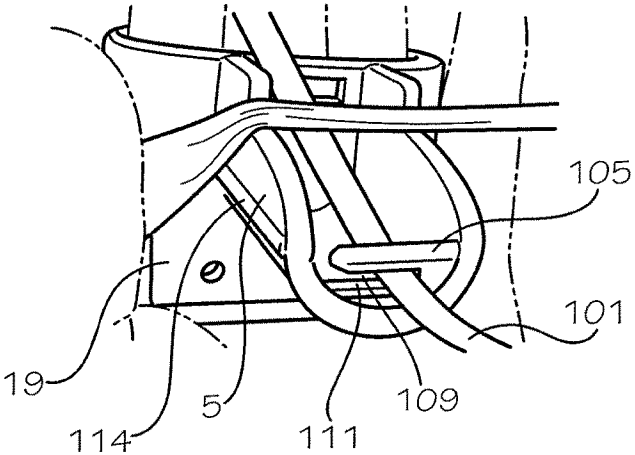
Figure 6E:
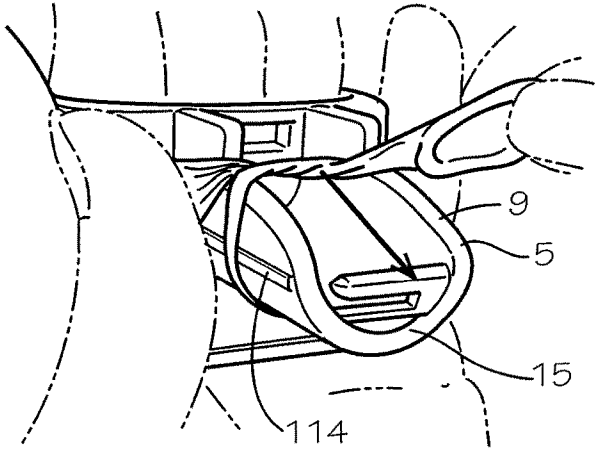
Figure 6G:
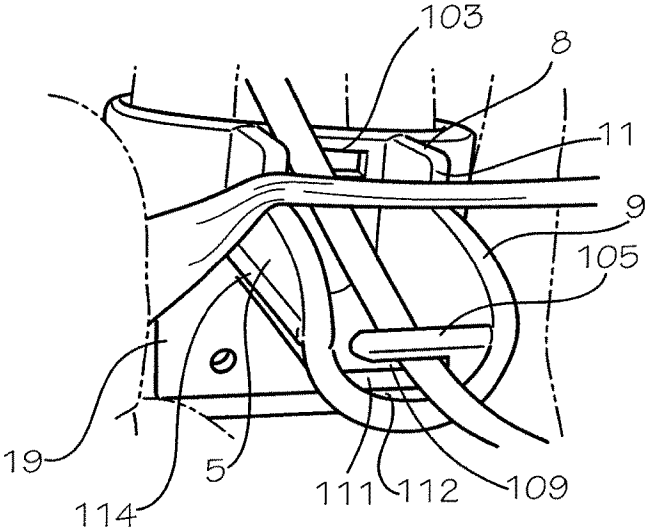

FIG. 6A illustrates the device on three fingers of an operator's hand and the thumb pressing a portion of the inflated balloon against the shoulder 118 and pulling a tail end of the balloon laterally across the plateaus 10 and the open cantilever 5. FIG. 6B illustrates the stretched balloon tail wrapped across a side, under the cantilever, and across the proximate side in preparing for forming the knot 30. FIG. 6C illustrates the leading edge of the tail of the balloon inserted over the initially stretched portion of the balloon and downwardly into the recess 17 proximate the base 1, with the leading end then pushed upwardly from the recess proximate the end 15. FIG. 6D illustrates the tail end of the balloon grabbed for detaching from the device. FIGS. 6E and 6F illustrate the operator pulling the tail end tail of the balloon rapidly and smoothly outwardly in a direction away from the base 1 from the cantilever 5 along a line substantially coaxial with a longitudinal axis of the cantilever. Pulling the tail pulls the stretched balloon portions along the arcuate edges 9 and past or over the radiused portion 13 of the end 15. The ribbon 101 (not illustrated in FIG. 6E or 6F) if present slides out of the gap 109 of the flange 105. FIG. 6G illustrates positioning the ribbon 101 though the fingers, through the retainer slot 107 of the ribbon retainer 103 in the base 1, in the recess 17 of the cantilever 5, and through the passageway 112 for arch balloon construction. Alternatively, as shown in FIG. 6*h*, a ribbon 101 may be received in the slot 109 for attachment and subsequent quick release thereform for single balloon construction without passing through the slot 107 in the base 101.

It thus is seen that the device provides an easier manner of tying a balloon by a device with one or more structural features disclosed herein by providing shoulders which aid in sealing the neck of the balloon, a surface lateral of an ear of a cantilever that aids in sealing the neck of the balloon, an angled slot floor for directing the ribbon downwardly into the U-shaped valley of the cantilever for ease of grasping and positioning of ribbon for securing to a knot of a tied balloon, exterior ridge(s) which aid in slipping the balloon off the cantilever due to the reduced frictional contact area between the balloon and the cantilever, the matte finish for further reducing frictional contact during a removal step, an acruate distal edge of a brace tab for distribution of loading during balloon tying operations, and a planar bevel surface in a back side-palm side surface of a brace tab for distribution of loading during balloon tying operations.

The forgoing describes the present invention in various illustrative embodiments of the invention. Those skilled in the art may recognize other equivalents to the specific embodiments described herein which equivalents are intended to be encompassed by the claims attached hereto.

What is claimed is:

1. A portable balloon tying device, comprising:

a base configured to receive a support structure, said base is a vertically extending tube, and wherein said base includes a ribbon slot extending through said tube, and an elongated cantilever extending outwardly from said base, said cantilever having an exterior surface with at least one outwardly, longitudinally extending ridge, whereby a ribbon extends through the ribbon slot and along the cantilever for being tied to a neck of an inflated balloon during knotting.

2. The portable balloon tying device of claim 1, wherein said elongated cantilever has a U-shaped cross section, and wherein said at least one outwardly longitudinally extending ridge extends from a bottom of said cantilever.

3. The portable balloon tying device of claim 1, wherein said elongated cantilever has a U-shaped cross section, and wherein said at least one outwardly longitudinally extending ridge includes two oppositely disposed ridges extending from opposite sides of said cantilever.

4. The portable balloon tying device of claim 1, wherein said elongated cantilever has a U-shaped cross section, and wherein said at least one outwardly longitudinally extending ridge includes two oppositely disposed ridges extending from opposite sides of said cantilever and one ridge extending from a bottom of said cantilever.

5. The portable balloon tying device of claim 1, wherein said base includes at least one vertically extending elongated shoulder extending outwardly from said tube.

6. The portable balloon tying device of claim 1, wherein said ribbon slot has a floor which is angled upwardly from an external surface of said tube to an internal surface of said tube.

7. The portable balloon tying device of claim 1, wherein said cantilever includes two oppositely disposed sidewalls, each sidewall having a top edge, a retaining edge extending generally normally from said top edge, and a bottom edge extending generally normally from said retaining edge.

8. The portable balloon tying device of claim 7, wherein said cantilever further includes an arcuate holding edge extending from said bottom edge.

9. The portable balloon tying device as recited in claim 1, wherein the exterior surface of the elongated cantilever has a matte finish.

10. A portable balloon tying device comprising:

a tubular base with a channel there through to receive a support structure, and an elongated cantilever having a U-shaped cross section extending outwardly from said base, at least one planar surface portion extending outwardly from said tubular base closely adjacent the junction point between said tubular base and said elongated cantilever, and said cantilever has an exterior surface with three outwardly, longitudinally extending ridges.

11. The portable balloon tying device of claim 10, wherein said base has a generally oblong shaped cross section and wherein said planar surface portion extends outwardly from said oblong shaped cross section.

12. The portable balloon tying device of claim 10, wherein said base includes a ribbon slot extending through a wall thereof.

13. The portable balloon tying device of claim 12, wherein said ribbon slot has a floor which is angled upwardly from an external surface of the base to an internal surface of the base.

14. The portable balloon tying device of claim 10, wherein said cantilever includes two oppositely disposed sidewalls, each sidewall having a top edge, a retaining edge extending generally normally from said top edge, and a bottom edge extending generally normally from said retaining edge.

15. The portable balloon tying device of claim 14, wherein said cantilever further includes an arcuate holding edge extending from said bottom edge.

16. The portable balloon tying device as recited in claim 10, wherein the exterior surface of the elongated cantilever has a matte finish.

17. A portable balloon tying device comprising:

a tubular base configured to receive a support structure, said tubular base having an exterior surface, an interior surface opposite said exterior surface, a top portion, and a bottom portion opposite said top portion;

an elongated cantilever extending outwardly from said base, said cantilever having a U-shaped cross section, and a ribbon slot extending through said tubular base within the confines of the U-shaped cross section of the cantilever, said ribbon slot having a floor sloped upwardly towards said top portion as it extends from said exterior surface towards said interior surface.

18. The portable balloon tying device of claim 17, wherein said cantilever has an exterior surface with at least one outwardly, longitudinally extending ridge.

19. The portable balloon tying device of claim 17, wherein base includes at least one vertically extending elongated shoulder.

20. The portable balloon tying device as recited in claim 17, wherein an exterior surface of the elongated cantilever has a matte finish.

21. A portable balloon tying device comprising:

a tubular base configured to receive a support structure, said tubular base having an exterior surface, an interior surface opposite said exterior surface, a top portion, and a bottom portion opposite said top portion;

a brace tab extending from the bottom portion and terminating at a distal edge with a flange extending laterally therefrom and having an arcuate surface for stabilized resting on a portion of a support structure during use of the balloon tying device;

an elongated cantilever extending outwardly from said base, said cantilever having a U-shaped cross-section for receiving a ribbon therein for securing to a balloon; and a flange extending from an inner surface of the U-shaped cross-section of the cantilever between the opposing walls with a gap between an opposing portion of the inner surface and a distal end of the flange for receiving a portion of the ribbon therethrough.

22. A portable balloon tying device comprising:

a tubular base configured to receive a support structure, said tubular base having an exterior surface, an interior surface opposite said exterior surface, a top portion, and a bottom portion opposite said top portion;

a brace tab extending from the bottom portion and terminating at a distal edge for stabilized resting on a portion of a support structure during use of the balloon tying device, a bevel on a surface of the brace tab proximate the base on a portion proximate a side edge and the distal end of the brace tab, for bearing contact with a portion of the support structure during use of the balloon tying device; and an elongated cantilever extending outwardly from said base, said cantilever having a U-shaped cross-section, for receiving therein a ribbon for securing to a balloon.

23. A portable balloon tying device comprising:

a tubular base configured to receive a support structure, said tubular base having an exterior surface, an interior surface opposite said exterior surface, a top portion, and a bottom portion opposite said top portion; and an elongated cantilever extending outwardly from said base, said cantilever having a U-shaped cross-section, and a distal end having a first slot and a second slot, the first slot defined by a cross bridge extending between opposing sides of the cantilever and spaced above a floor of the cantilever for receiving therethrough at least one ribbon for securing to a balloon, the second slot defined by a cantilever flange extending from one of the opposing sides of the elongated cantilever and vertically spaced from the cross bridge and a gap between a distal end of the cantilever flange and the other of the opposing sides of the elongated cantilever for receiving a ribbon through the gap into the second slot for securing to a balloon and readily released from the gap thereafter.

24. A portable balloon tying device comprising:

a tubular base with a channel there through to receive a support structure and said base includes a ribbon slot extending through a wall thereof; and an elongated cantilever extending outwardly from said base, at least one planar surface portion extending outwardly from said tubular base closely adjacent the junction point between said tubular base and said elongated cantilever whereby a ribbon extending through the ribbon slot and along the cantilever for being tied to a neck of an inflated balloon during knotting while the neck is pressed against the planar surface portion.

25. The portable balloon tying device of claim 24, wherein said ribbon slot has a floor which is angled upwardly from an external surface of said tube to an internal surface of said tube.

26. The portable balloon tying device as recited in claim 24, wherein an exterior surface of the elongated cantilever has a matte finish.

27. A portable balloon tying device comprising:

a tubular base with a channel there through to receive a support structure; and an elongated cantilever extending outwardly from said base, at least one planar surface portion extending outwardly from said tubular base closely adjacent the junction point between said tubular base and said elongated cantilever, said cantilever includes two oppositely disposed sidewalls, each sidewall having a top edge, a retaining edge extending generally normally from said top edge, and a bottom edge extending generally normally from said retaining edge.

28. The portable balloon tying device of claim 27, wherein said cantilever further includes an arcuate holding edge extending from said bottom edge.

29. The portable balloon tying device as recited in claim 27, wherein an exterior surface of the elongated cantilever has a matte finish.

* * * * *